US008105127B2

(12) United States Patent
Heston

(10) Patent No.: US 8,105,127 B2
(45) Date of Patent: Jan. 31, 2012

(54) TIMBER TOY BUILDING SYSTEM

(76) Inventor: Christian Heston, Columbia, MO (US)

( * ) Notice: Subject to any disclaimer, the term of this patent is extended or adjusted under 35 U.S.C. 154(b) by 282 days.

(21) Appl. No.: 12/587,353

(22) Filed: Oct. 6, 2009

(65) Prior Publication Data

US 2011/0081824 A1 Apr. 7, 2011

(51) Int. Cl.
*A63H 33/04* (2006.01)
*A63H 13/00* (2006.01)

(52) U.S. Cl. ..... 446/85; 446/106; 446/126; 446/95

(58) Field of Classification Search ..... 446/85, 446/95, 106–108, 115, 118, 126
See application file for complete search history.

(56) References Cited

U.S. PATENT DOCUMENTS

| | | | | | |
|---|---|---|---|---|---|
| 2,712,200 | A * | 7/1955 | Dearling | 446/116 |
| 2,844,910 | A * | 7/1958 | Korchak | 446/106 |
| 3,007,279 | A * | 11/1961 | Korchak | 446/106 |
| 4,170,083 | A * | 10/1979 | Freelander et al. | 446/95 |
| 4,309,851 | A * | 1/1982 | Flagg | 52/2.21 |
| 4,740,188 | A * | 4/1988 | Coster | 446/114 |
| 4,809,146 | A * | 2/1989 | Johnson | 362/367 |
| 4,991,726 | A * | 2/1991 | Johnson | 211/189 |
| 5,310,376 | A * | 5/1994 | Mayuzumi et al. | 446/107 |
| 6,739,937 | B2 * | 5/2004 | Snelson | 446/107 |
| 6,923,705 | B2 * | 8/2005 | DeSalvo et al. | 446/106 |

* cited by examiner

*Primary Examiner* — Kien Nguyen
(74) *Attorney, Agent, or Firm* — Mark Manley

(57) ABSTRACT

A log based building system including a plurality of logs having different lengths and a square cross section; at least one connector having an opening sized to slide over an end of a stack of at least two logs and thereby clamp the at least two logs together. The two logs can include notches that allow a third log to be clamped in place by the connector, this arrangement allows for building toys with long reach arms.

17 Claims, 12 Drawing Sheets

Fig. 8
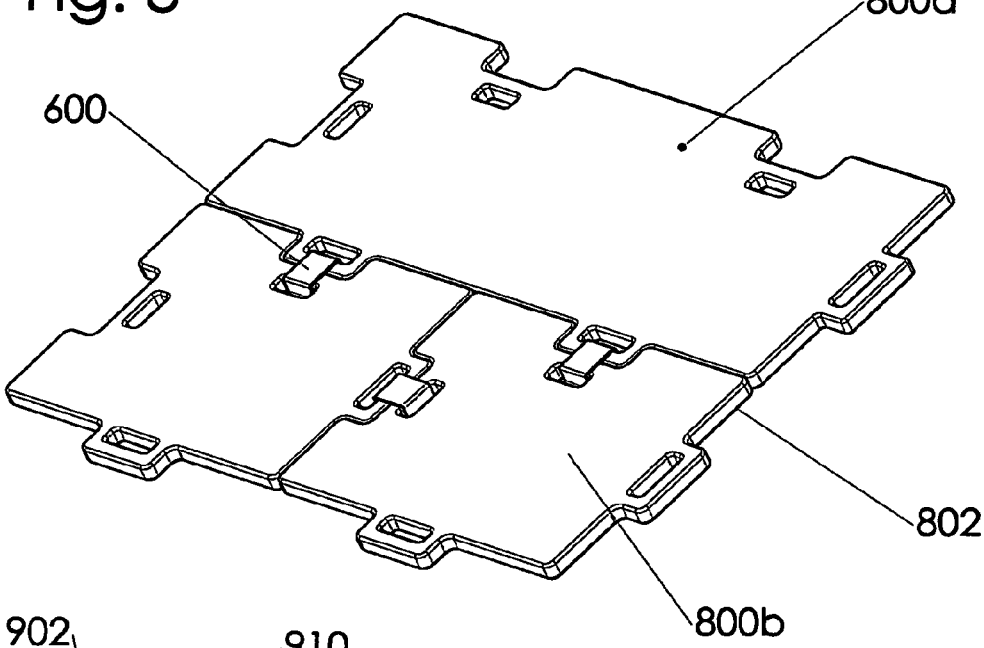
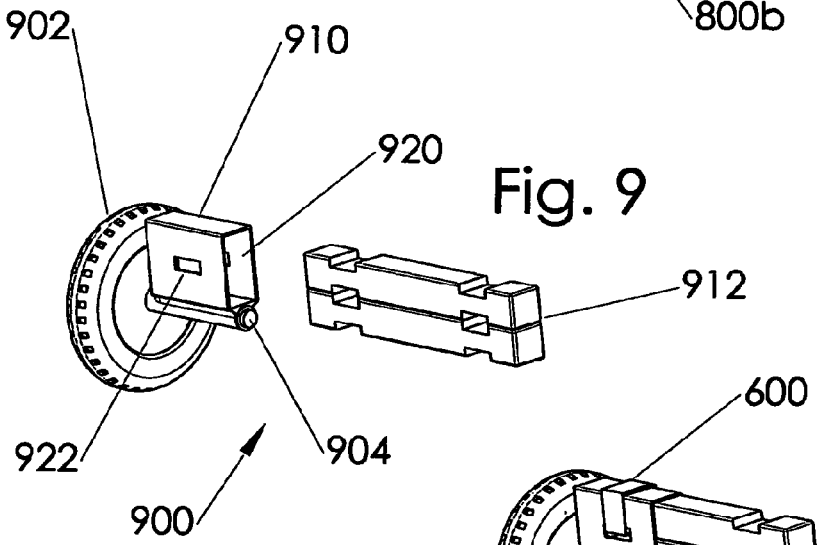
Fig. 9
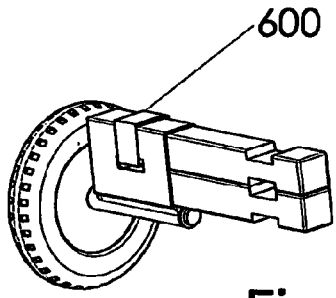
Fig. 10

TIMBER TOY BUILDING SYSTEM

BACKGROUND OF THE INVENTION

In the toy industry it is desirable to engage children with toys that are both fun and beneficial. It is common to design toys that are educational and that encourage creativity.

U.S. Pat. No. 6,059,630 shows a typical log building toy. It shows a variety of log shapes as well as some specialty pieces. The idea of a log building toy is fine, but in this example limited primarily to building a cabin like structure.

U.S. Pat. No. 5,215,490 discloses a panel building system.

As can be seen there is a need for a log building toy that allows for a greater range of play construction projects.

SUMMARY OF THE INVENTION

The present invention relates to a timber log based building system including a plurality of logs having different lengths and a square cross section. At least one connector having an opening sized to slide over an end of a stack of at least two logs and thereby clamp the two logs together. The two logs can include notches that allow a third log to be clamped in place by the connector, this arrangement allows for building toys with long reach arms.

These and other advantages of the present invention will become apparent from the detailed description of the invention.

BRIEF DESCRIPTION OF THE DRAWINGS

FIG. 8 shows a plurality of flat panels assembled;

FIG. 9 shows an exploded view of an assembly of components;

FIG. 10 shows the assembly of FIG. 9 assembled;

DETAILED DESCRIPTION OF THE DEVICE

Figure 1:
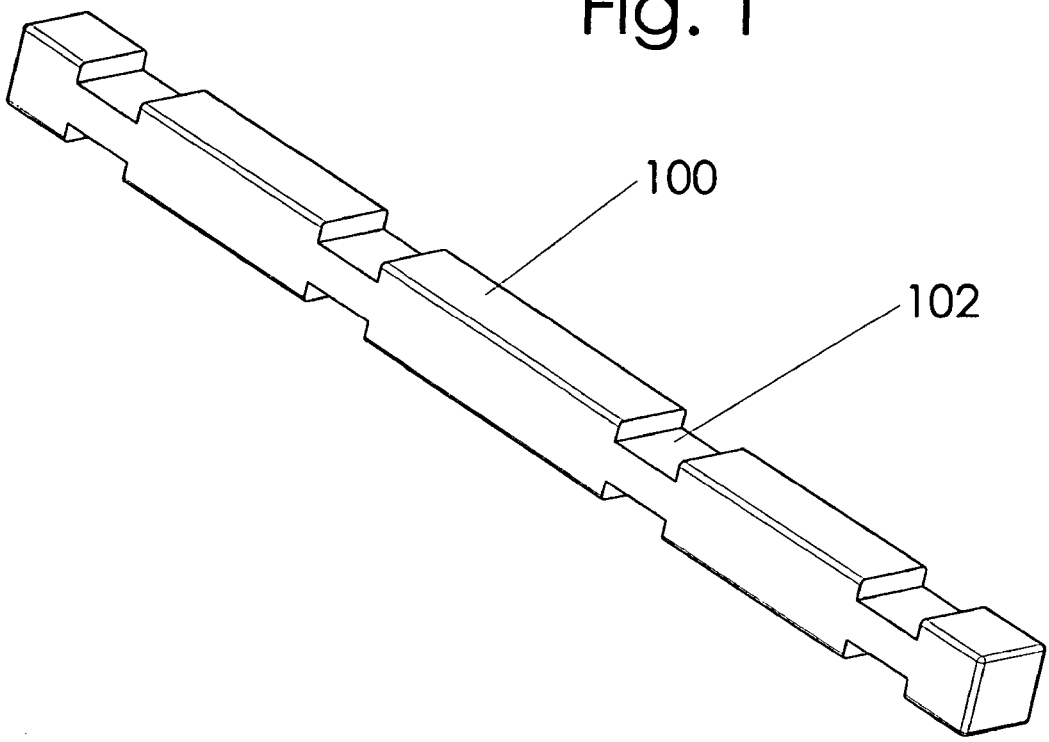
FIG. 1 shows a partial building piece.

FIG. 1 shows a sample building log 100. The log 100 has several notches 102 that allow for logs 100 and other building components to temporarily fit together. The log has a square cross section 104 and can have several notches 102 along the length of the log 100.

Figure 2:
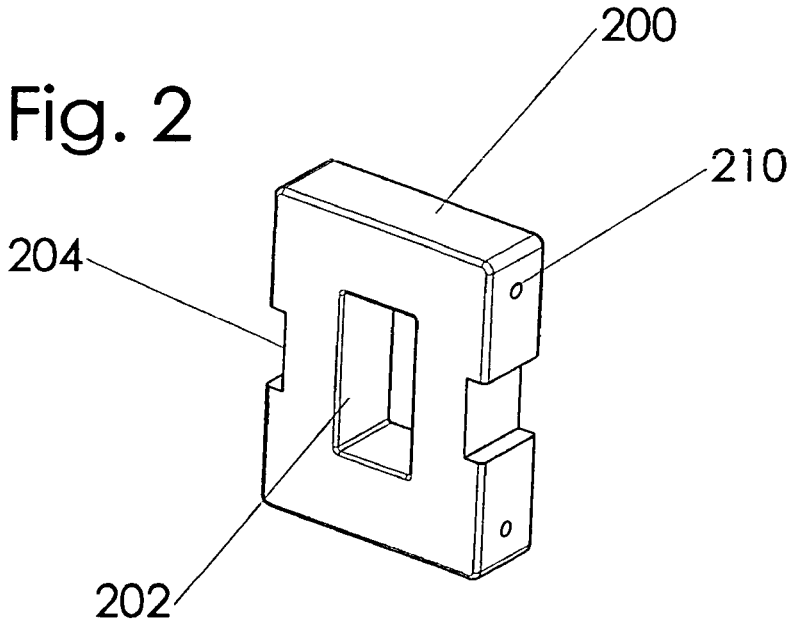
FIG. 2 shows a specialty connector.
Figure 3:
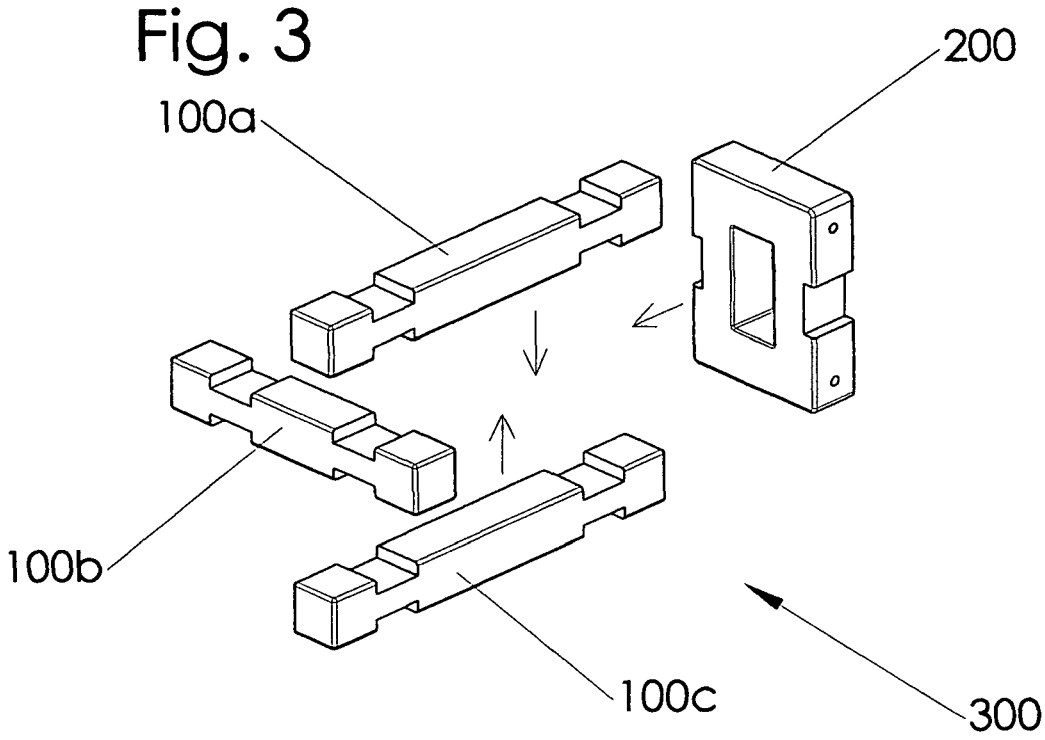
FIG. 3 shows an exploded view of an assembly of log building members.
Figure 4:
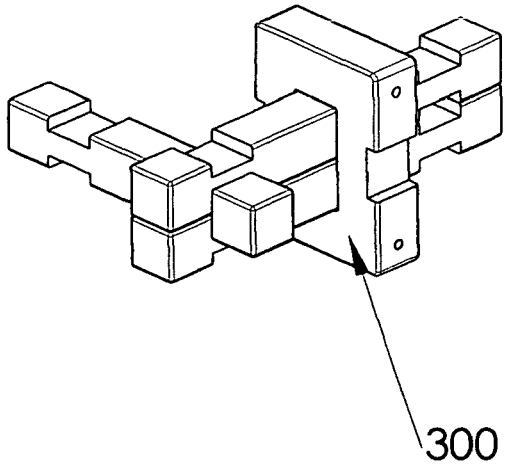
FIG. 4 shows the system of FIG. 3 assembled.

FIG. 2 shows a special connector 200. FIGS. 3 and 4 show how the special connector 200 can be used to connect three logs 100 *a, b, c*. The connector 200 includes an opening 202 that is large enough to fit over two logs as shown in FIGS. 3 and 4 to hold the logs together. The connector 200 includes notches 204 that allow for connection of logs 100 and other building components to the exterior of the connector 200. The connector 200 can include dowels 210 that run through the connector 200, the purpose of the dowels 210 is to prevent the wooden connector 200 from splitting and breaking. The dowels 210 will run perpendicular to the wood grain.

FIG. 3 shows an exploded view of a set 300 of logs 100*a*, 100*b*, 100*c* and connector 200. FIG. 3 shows that the two logs 100*a* and 100*b* have notches that align to form an opening that will clamp over the log 100*c* and as can be seen in FIG. 3 when the connector 200 slides over the ends of logs 100*a* and 100*b* they are clamped in place and will hold log 100*c* in the notch opening. The connector 200 can slide along the length of the log stack 100 *a, b* in a direction parallel to the length. This arrangement allows for a building system to have a long reach because any length log can be held by a connector 200 and/or the stack 100 *a, b*. Without the connector 200 the log 100*c* would have enough torque to open up the connection between the logs 100*a* and 100*b* and the assembly would fall apart. Arrows in FIG. 3 show how the parts 100 *a, b, c* and connector 200 of the set 300 come together. FIG. 4 shows the set 300 assembled.

Figure 5:
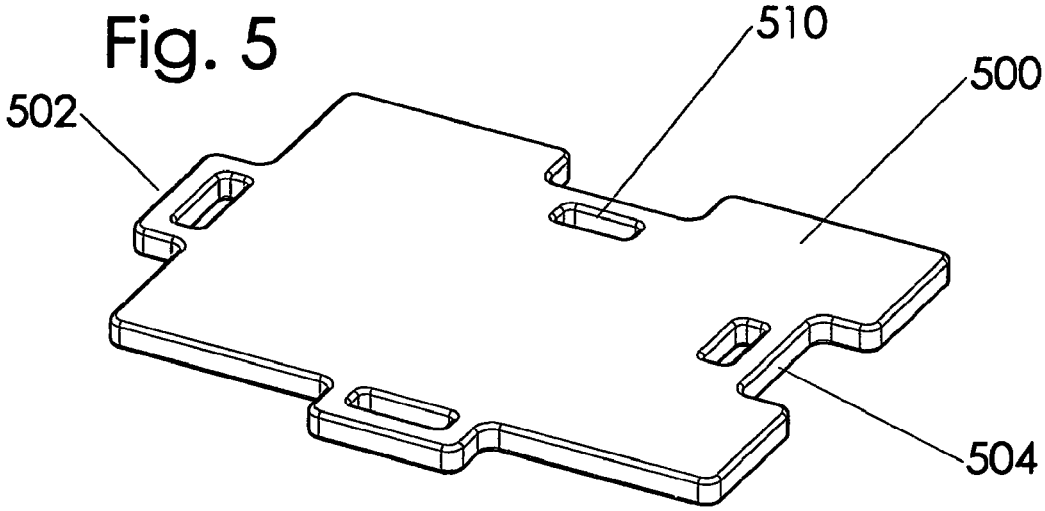
FIG. 5 shows a flat panel piece.

FIG. 5 shows a panel piece 500 for use with the building system. The panel can be used as a multi-panel set or roof (FIG. 8) or as a bridge deck (FIG. 9) or for any other large flat section. FIG. 5 shows that the panel 500 has cooperating tabs 502 and notches 504 that aid in fitting the panels 500 together. Each tab 502 includes a slot 510 sized to accept a connector such as loop pile fastener 600.

Figure 6:
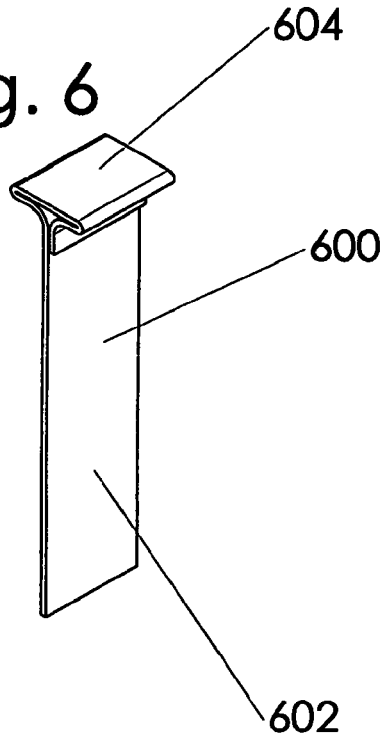
FIG. 6 shows a loop pile fastener.
Figure 7:
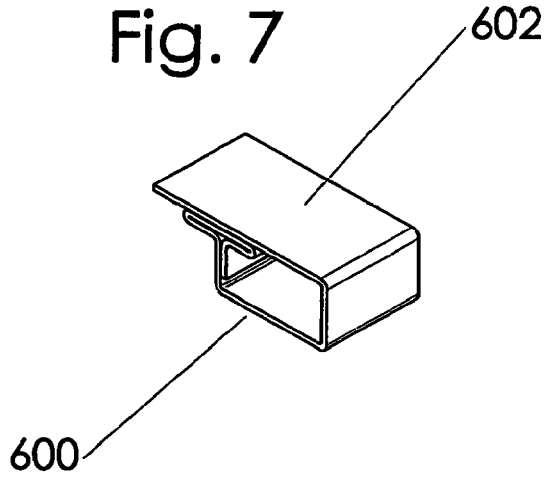
FIG. 7 shows the loop pile fastener of FIG. 6 formed into a loop.
Figure 13:
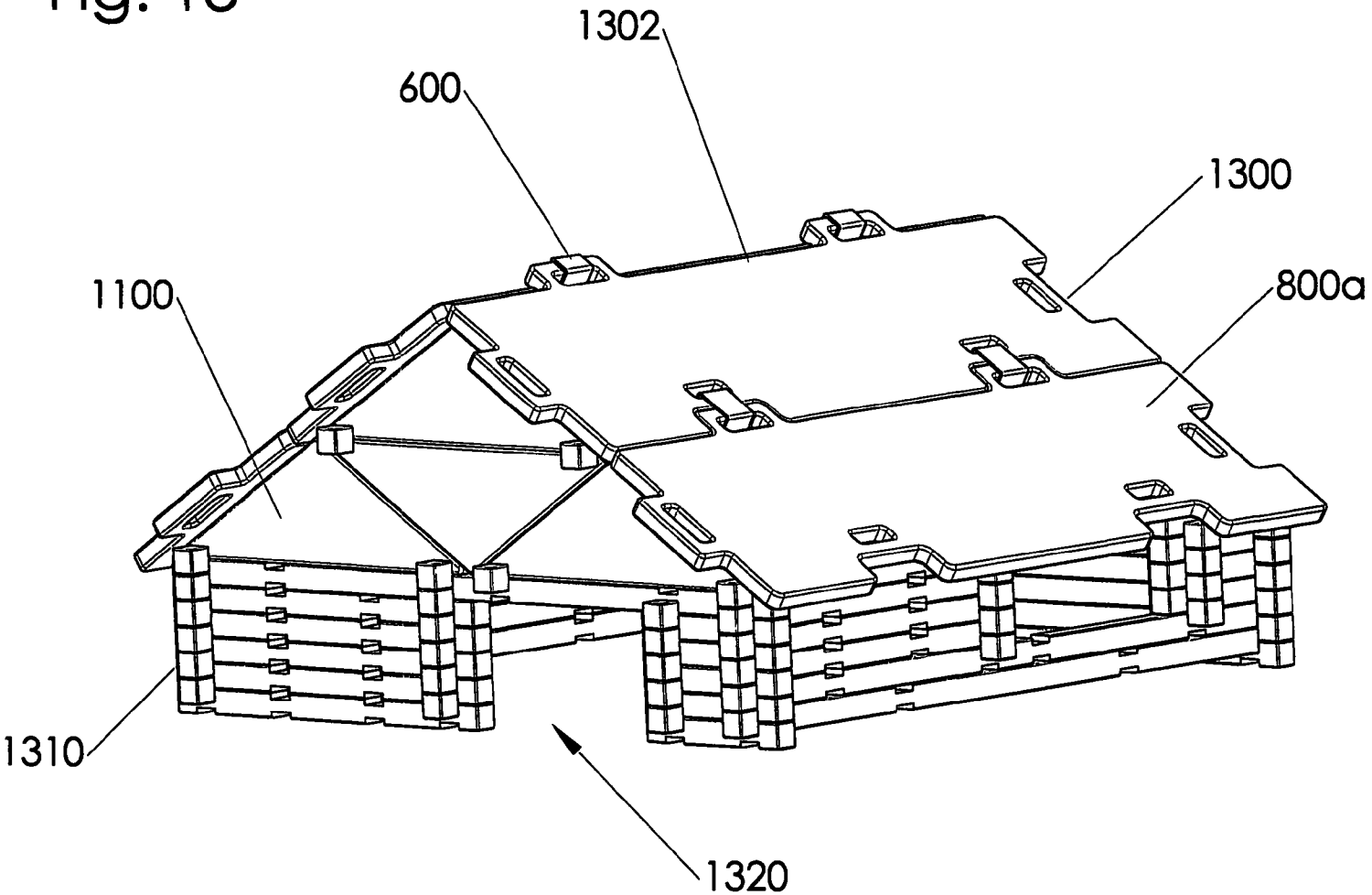
FIG. 13 shows a cabin assembly.

FIG. 6 shows a loop pile fastener 600. The fastener 600 has a section 602 with loop and a second section 604 with pile to form the fastener. FIG. 7 shows how the fastener 600 can be formed into a loop to hold pieces together. FIGS. 8, 10 and 13 show examples of how the loop pile fastener 600 is used to safely hold panels and pieces together. The fastener 600 is safe and easy for children to use.

FIG. 8 shows how panels 800*a* and 800*b* can be fastened together using the fastener 600 to form a larger composite panel 802

FIGS. 9 and 10 show a wheel assembly 900. As shown in FIG. 9 the wheel assembly includes a wheel 902 with an axle 904 and a connector 910. The connector 910 is similar to the connector 200 in that it is sized to accept a stack of two logs 912 and will clamp those logs 912 together. The connector 910 provides a way for a child to add wheels 902 to a toy. FIG. 10 shows a toy assembly with wheels 902. The connector 910 includes an opening 920 that aligns with the slots 922 when the logs 912 are placed in the connector as shown in FIG. 10. A fastener 600 locks the logs 912 into the connector 910. The fastener 600 can be something as simple as a strip of loop pile fastener 600 a dowel or threaded fastener for example. The connector 910 could be aluminum or clear plastic for example.

Figure 12:
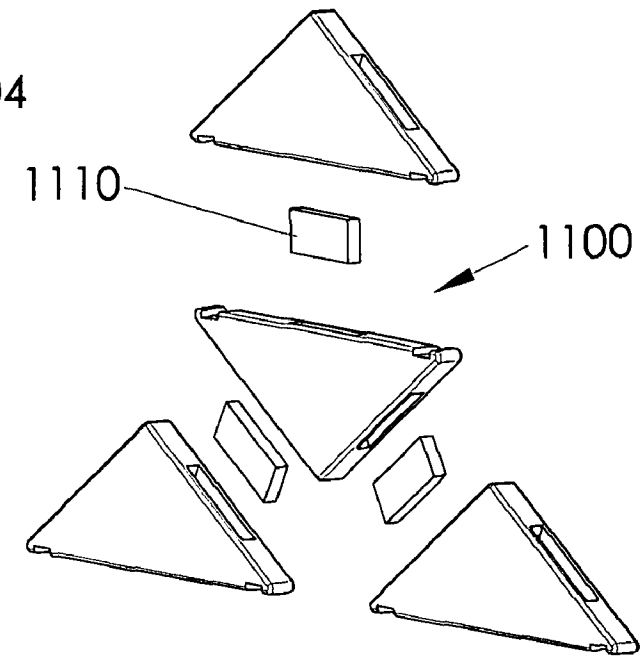
FIG. 12 shows an exploded view of the assembly of FIG. 11.
Figure 11:
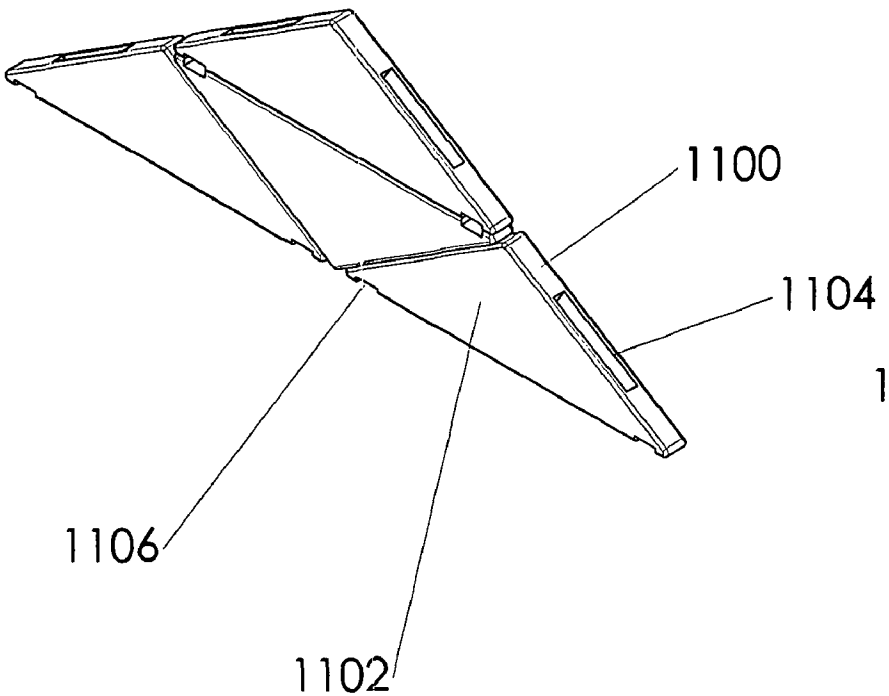
FIG. 11 shows a view of a roof end assembly.

FIGS. 11 and 12 show a roof end assembly 1100. FIG. 11 shows an assembly built from 4 individual pieces 1102. The pieces 1102 include slots 1104 that are used to hold the assembly 1100 together. Each piece 1102 includes notches 1106. FIG. 12 shows an exploded view of the assembly 1100 that shows wafers 1110 that cooperate with the slots 1104 to hold the assembly 1100 together. The wafers 1110 lightly press fit into the slots 1104 such that the friction of the wafer against the walls of the slot 1104 will hold the assembly 1100 together.

FIG. 13 shows an example toy assembly 1300. In this case the toy assembly 1300 is a cabin that includes a roof 1302 made from panels 800*a* and the roof uses triangular pieces

1102 to create the gable section of the roof 1100. The roof 1102 and gables are supported on a generally rectangular log cabin frame 1310 that is made from a plurality of different length logs 100. The frame 1310 includes openings for doors 1320 and windows.

Figure 14:
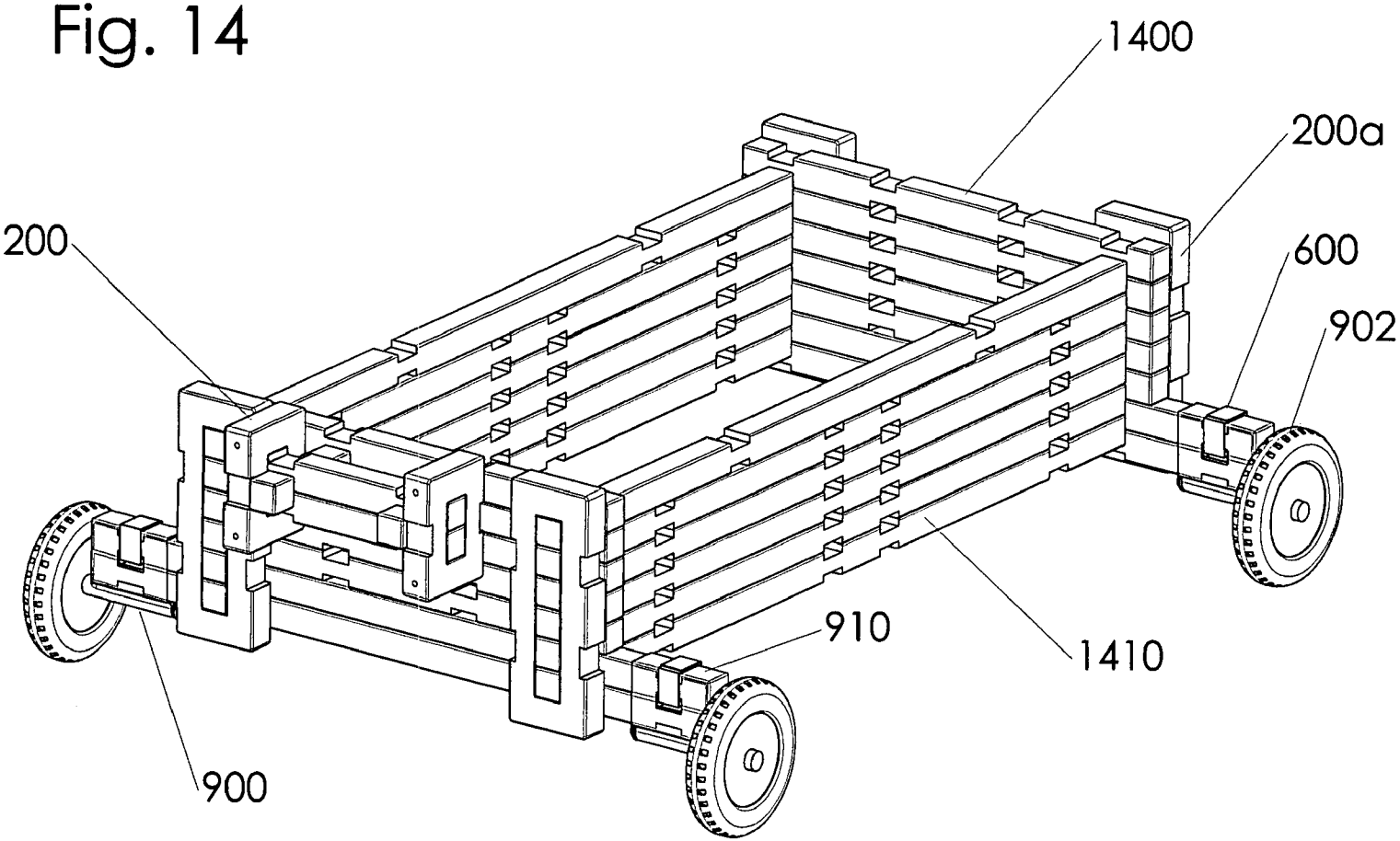
FIG. 14 shows a vehicle assembly.

FIG. 14 shows a wheeled toy 1400 made from the log system. The vehicle 1400 includes 4 wheel systems 900. The wheeled toy 1400 shows that a longer connector 200*a* can be made. The connector 200*a* connects 6 log ends together. Any size connector is possible. The vehicle 1400 includes a frame 1410 held together by the connectors 200, 200*a* and 900.

Figure 15:
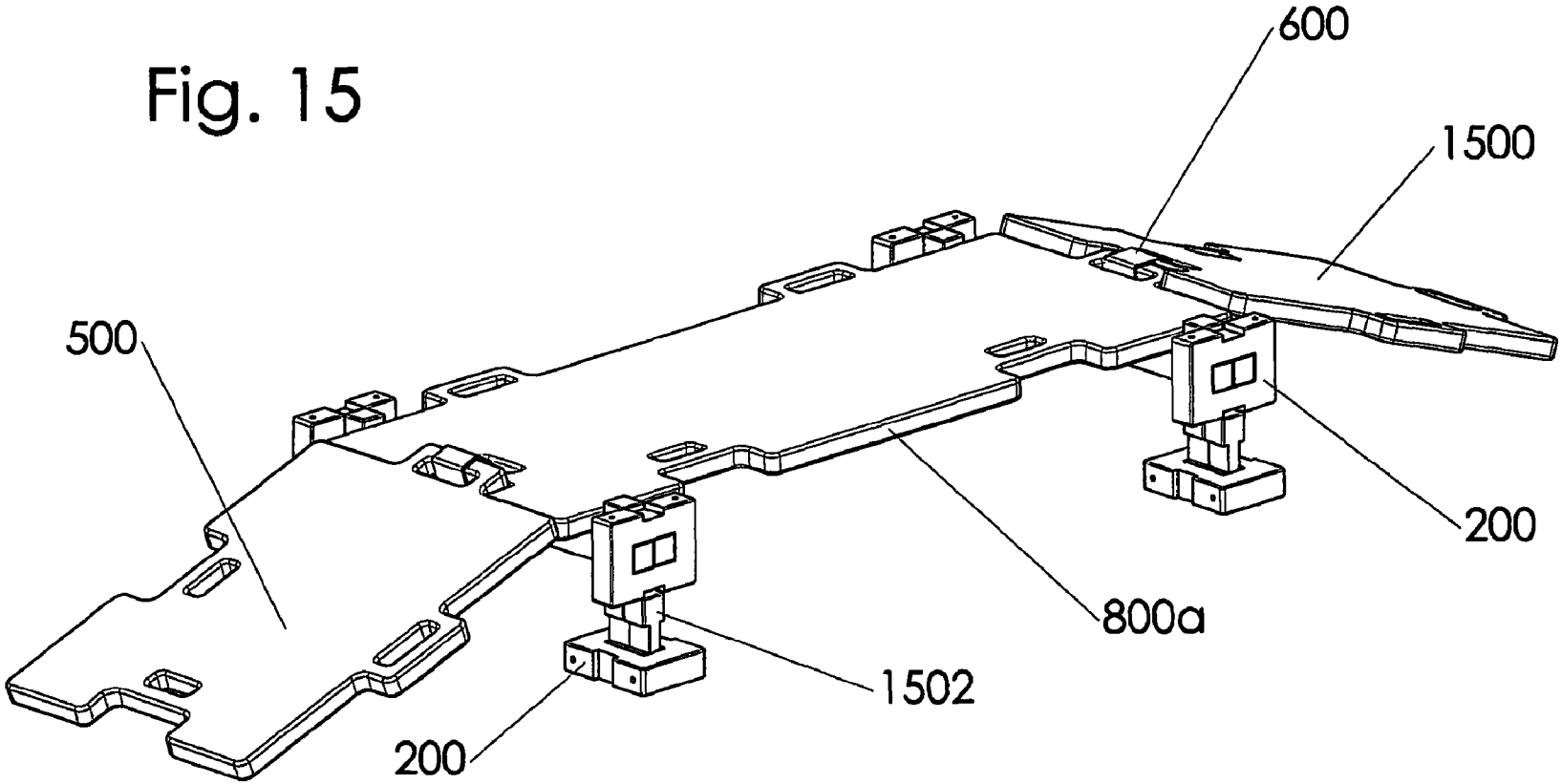
FIG. 15 shows a bridge assembly.

FIG. 15 shows a bridge system 1500. FIG. 15 shows how panels 500 and 800*a* can fit together and be supported to create a bridge. The bridge 1500 includes connectors 200 to join logs and to create a footing 1502 for the bridge 1500.

Figure 16:
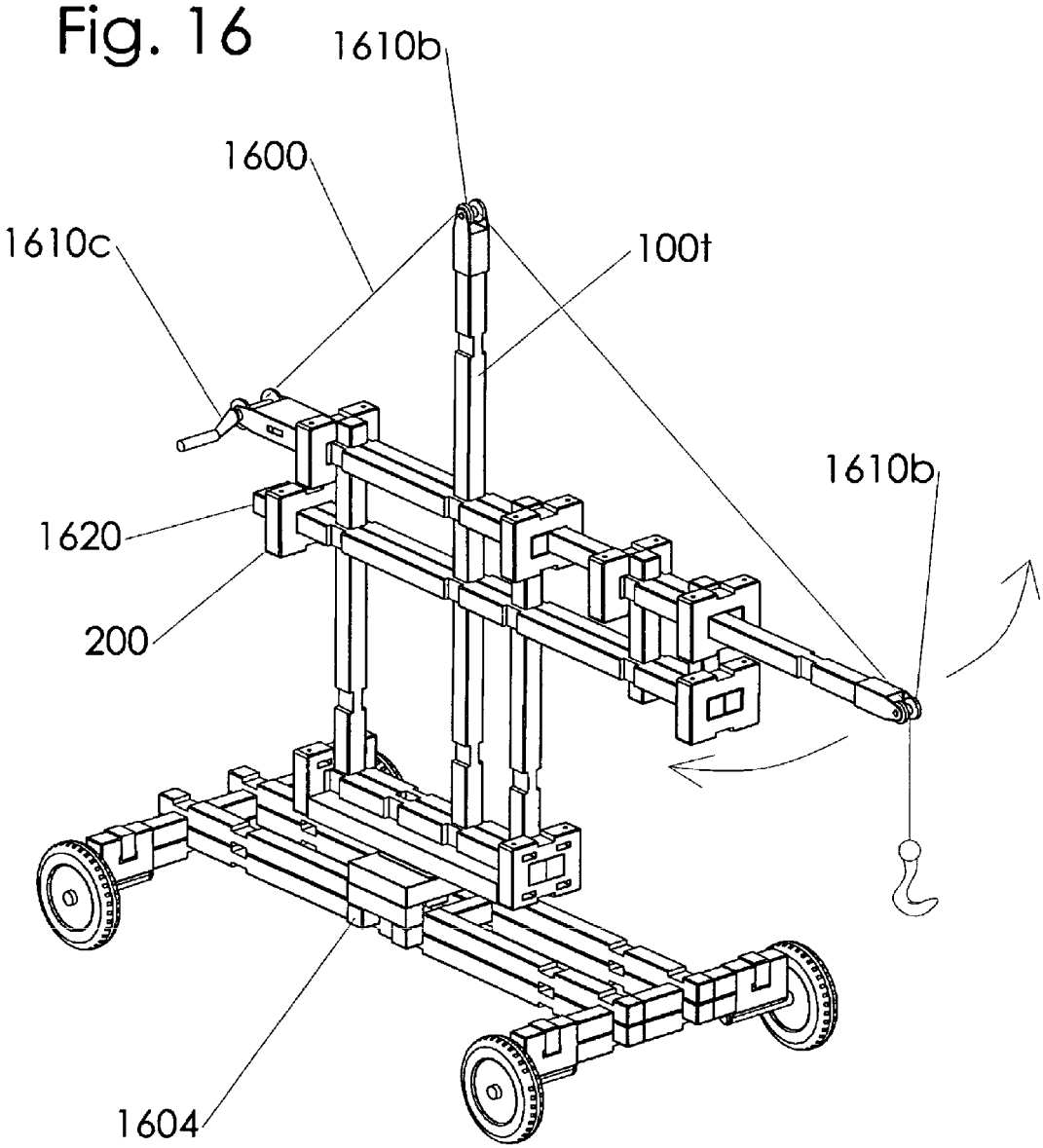
FIG. 16 shows a crane assembly.

FIG. 16 shows a crane system 1600. The wheeled crane 1600 shows how connectors 200 allow the user to build up in a way not possible with previous log toys. A single tall log 100*t* forms a tower for the crane 1600. The tower log 100*t* is supported by the crane frame 1604 which is clamped together by connectors 200. The crane 1600 includes a long reach arm base 1620 supported on the tower log 100*t* and a single log 1130 again reaches out from the long reach base. The crane 1600 can include specialty pulley assemblies 1610 *a, b, c* that would allow a child to actually use the crane to lift other toys.

Figure 17:
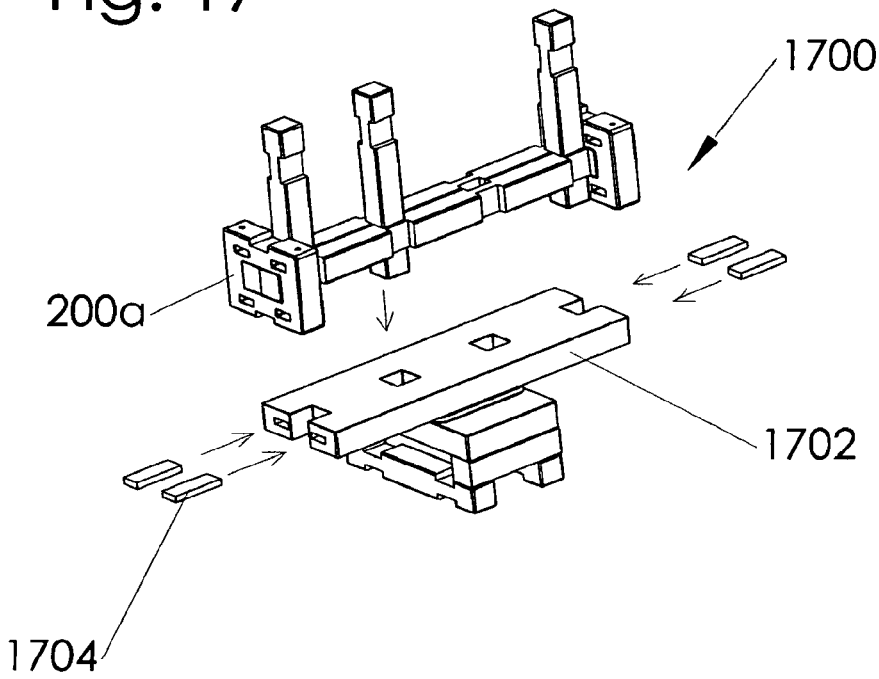
FIG. 17 shows a partial crane assembly.
Figure 18:
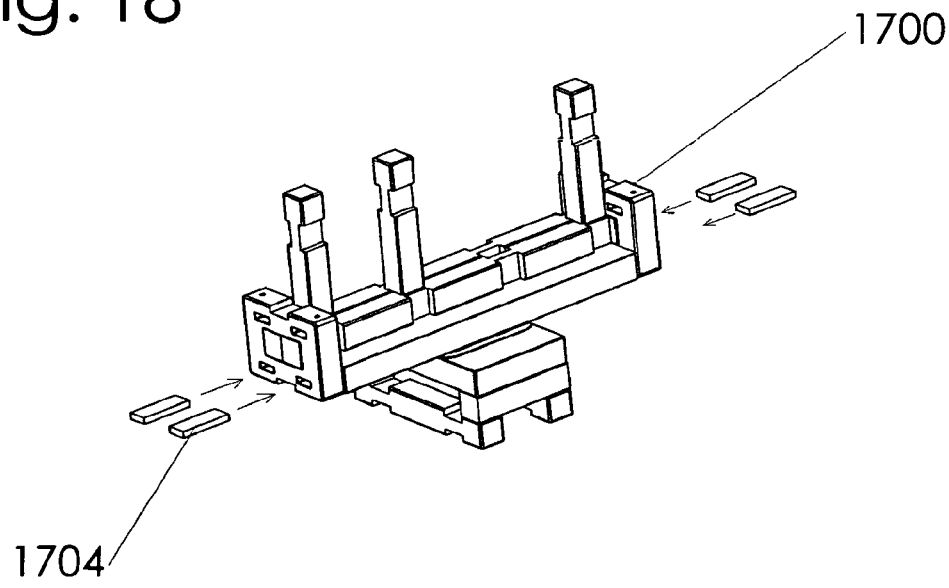
FIG. 18 shows a partial crane assembly.

FIG. 17 shows a partial assembly 1700 view of the crane 1600. The crane 1600 includes a special rotatable base 1702. Special connector 200*a* can cooperate with wafers 1704 to connect special connector 200*a* and log assembly 1710 to the crane 1600. FIG. 18 shows the next step of the assembly.

Figure 19:
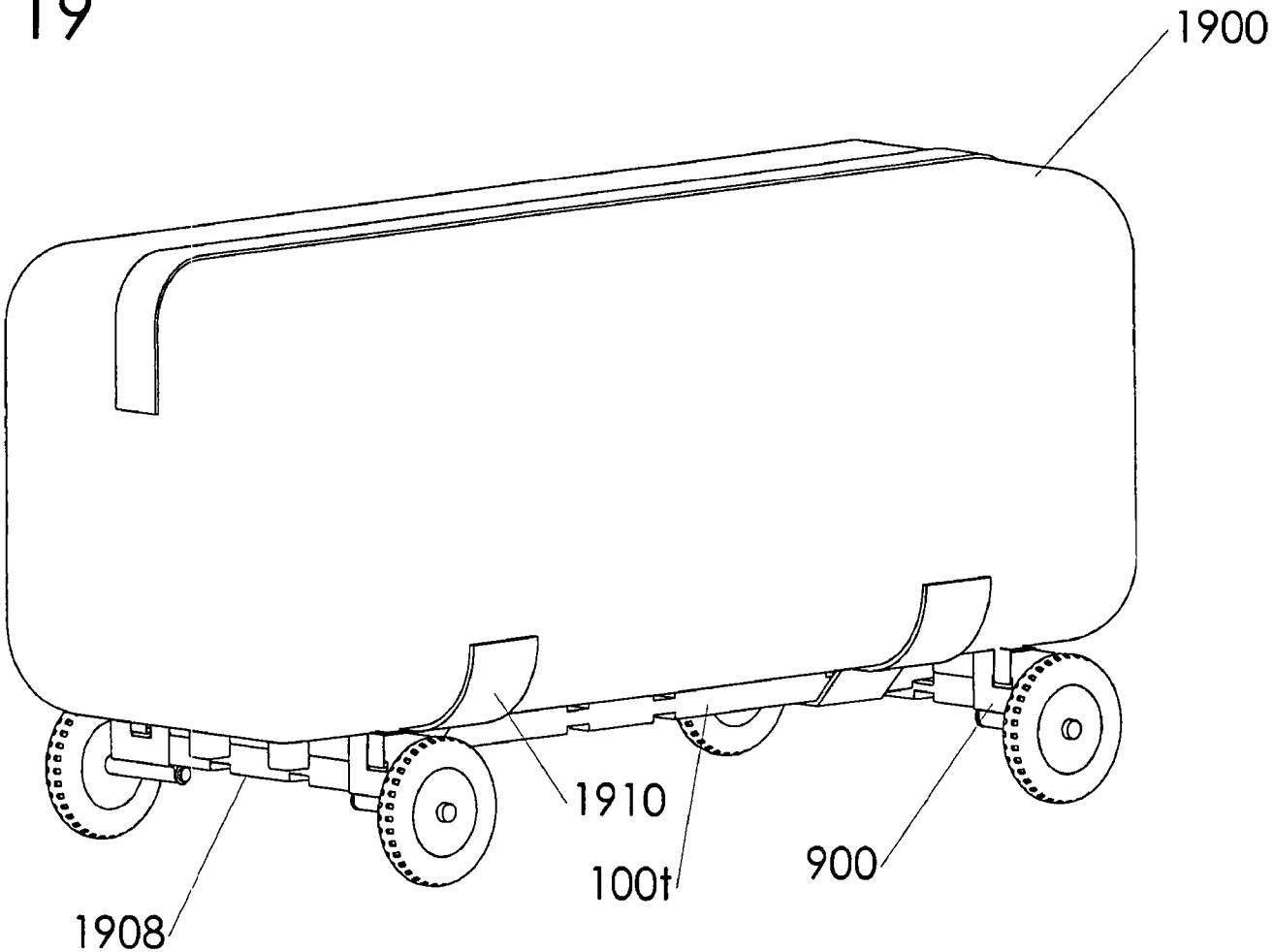
FIG. 19 shows a container bag.

FIG. 19 shows a toy containment carrier 1900. The container 1900 can include wheel assemblies 900 that attach to the outside of the container 1900 so that it can be wheeled around. The container 1900 can include a fabric bag 1904 with an opening 1906 across the top so that the log components of the system can be stored inside the bag 1904. The container 1900 includes a log frame 1908 that might include a central log 100*t* that serves as the main support. Hook and loop straps 1910 can serve to attach the bag 1904 to the frame 1908. The toy container 1900 is shown with 4 wheels, it could also be built with just 2 wheels. The bag 1904 can include a strap handle (not shown) that would make it easier to pull like a wagon.

Figure 20:
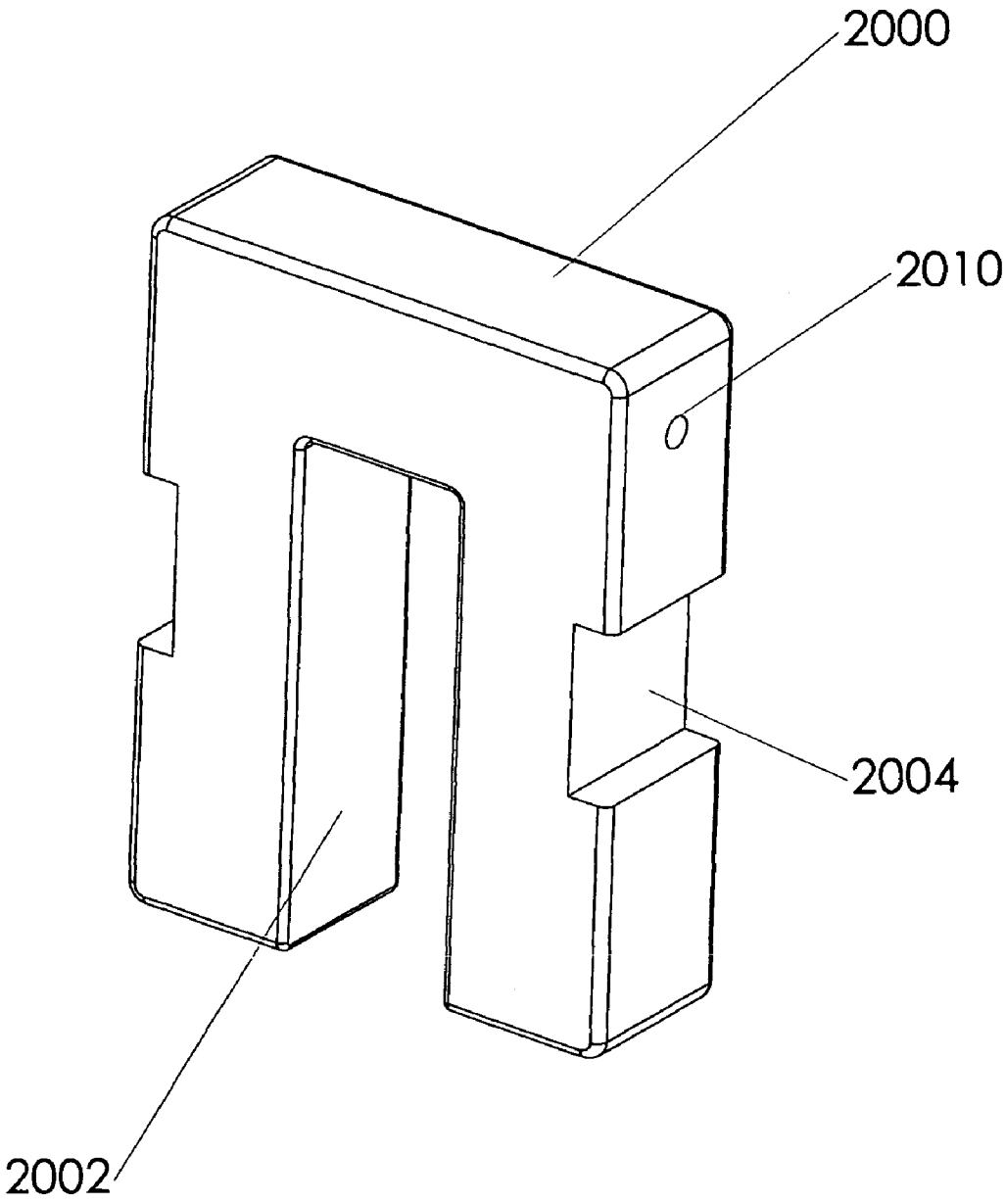
FIG. 20 shows an alternative connector.

FIG. 20 shows an alternative connector 2000 where the connector 200 has a 'u' shape. The connector 2000 will hook on over stacks of logs and act as a stop or support. The connector 2000 is similar to the connector 200 but instead of having a central opening it has a slot 2002.

The log system shown in FIG. 1 through 20 is based on a scale for example 1 inch. On the one inch scale the cross section of the log in FIG. 1 is 1 inch by 1 inch. The connector 200 is 1 inch thick and has an opening 202 that is 1 inch by 2 inches. The notch 204 is 1 inch by 1 inch. The stack of logs 612 is 1 inch by 2 inch. The outside dimensions of the connector 200 are 1 inch thick by 3 inches wide by 4 inches tall. The scale is described in terms of inches but could be based on any unit. The logs 100, connectors 200 will typically be made from wood, plywood, plastic or aluminum.

I claim:

1. A log based building system including a plurality of logs having different lengths and a square cross section;

at least one connector having an opening sized to slide over a stack of at least two logs and thereby temporarily hold the at least two logs together, wherein each of said two logs include at least one notch for connecting to other of said plurality of logs and wherein said connector is slidable along a length of said stack of logs past each said notch while holding said logs together.

2. The building system of claim 1 wherein the connector is wooden and has a thickness equal to a thickness of one of said plurality of logs.

3. The building system of claim 1 wherein the logs and the at least one connector are wooden and the logs and connectors have a common thickness and wherein the connector has outside dimensions of 3 units by 4 units and an inside opening of 1 unit by 2 units.

4. The building system of claim 1 wherein said plurality of logs includes a first log having a first length and a second log having a second length and a third log wherein said connector slides over said first and second log to hold them together and wherein said first log includes a first notch and wherein said second log includes a second notch and wherein said first and second notches line up to form an opening and said opening holds said third log when said connector clamps said first and second logs together and wherein said connector can slide along the length of the first and second log while the third log remains held in said opening.

5. The building system of claim 1 including a wheel mounted on said connector such that a wheeled toy can be assembled from said system.

6. The building system of claim 5 wherein said system includes a container to carry said logs and wherein said wheel can be connected to said container such that said container can roll on said wheel.

7. A toy building system including a plurality of logs having lengths and a square cross section;

at least one connector having an opening sized to slide over an end of a stack of at least two logs and thereby temporarily hold the at least two logs together wherein said plurality of logs includes a first log having a first length and a second log having a second length and a third log wherein said at least one connector slides over said first and second log to hold them together and wherein said first log includes a first notch and wherein said second log includes a second notch and wherein said first and second notches align to form an opening and said opening holds said third log when said connector slides onto said first and second logs and wherein said connector slides along the length of the first and second log while the third log remains held in said opening.

8. The toy building system of claim 7 wherein said logs and said connector have a common thickness dimension.

9. The toy building system of claim 8 wherein the logs and the at least one connector are wooden and wherein the connector has outside dimensions of 3 units by 4 units and an inside opening of 1 unit by 2 units.

10. The toy building system of claim 8 including a wheel mounted on a second connector, wherein said second connector will fit onto a second stack of two logs to hold the wheel onto the second stack such that a wheeled toy can be assembled.

11. The toy building system of claim 8 wherein said system includes a container to carry said logs and wherein a wheel can be connected to said container such that said container can roll on said wheel.

12. A building system including at least a first, second and third log having lengths and an identical square cross section;

wherein said first log includes a notch sized to receive said third log;

at least one connector having an opening sized to slide over an end of a stack of at least said first and second log and thereby temporarily hold the stack of at least said first and second logs together while said connector is movable past said notch.

13. The building system of claim 12 wherein said first log includes a first notch and wherein said second log includes a second notch and wherein said first and second notches align to form an opening and said opening holds said third log when said connector slides onto said first and second logs and wherein said connector is slidable along at least part of the length of the first and second logs while the third log remains held in said opening.

14. The building system of claim 13 wherein said logs and said connector are wooden and have dimensions based on a common unit of measure.

15. The building system of claim 14 wherein the connector has outside dimensions of 3 units by 4 units and an inside opening of 1 unit by 2 units and wherein the logs are 1 unit by 1 unit by a length.

16. The building system of claim 14 including a wheel mounted on a second connector, wherein said second connector will fit onto a stack of a fourth and fifth log to hold the wheel onto the stack such that a wheeled toy can be assembled.

17. The building system of claim 16 wherein said system includes a fabric container to carry said logs and wherein said wheel can be connected to said container such that said container can roll on said wheel.

* * * * *